US008166782B2

(12) United States Patent
Lim et al.

(10) Patent No.: US 8,166,782 B2
(45) Date of Patent: May 1, 2012

(54) DRUM TYPE WASHING MACHINE

(75) Inventors: Hee Tae Lim, Buchun-si (KR); Sang Wook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 598 days.

(21) Appl. No.: 11/345,373

(22) Filed: Feb. 2, 2006

(65) Prior Publication Data

US 2006/0169006 A1 Aug. 3, 2006

(30) Foreign Application Priority Data

Feb. 3, 2005 (KR) ..... 10-2005-0010138

(51) Int. Cl.
*D06F 25/00* (2006.01)

(52) U.S. Cl. ..... 68/20

(58) Field of Classification Search ..... 68/19.1, 68/19.2, 20

See application file for complete search history.

(56) References Cited

U.S. PATENT DOCUMENTS

| | | | | |
|---|---|---|---|---|
| 3,089,327 | A | 5/1963 | Stillwell, Jr. | |
| 4,446,706 | A * | 5/1984 | Hartwig | 68/24 |
| 5,979,195 | A | 11/1999 | Bestell et al. | |
| 6,256,823 | B1 * | 7/2001 | Kronbetter et al. | 8/158 |
| 2003/0200773 | A1 | 10/2003 | Hong et al. | |
| 2004/0045327 | A1 * | 3/2004 | Kim et al. | 68/19.2 |
| 2004/0079121 | A1 * | 4/2004 | Yabuuchi et al. | 68/19.2 |
| 2004/0103697 | A1 * | 6/2004 | Kim et al. | 68/18 R |
| 2004/0107743 | A1 * | 6/2004 | Kim et al. | 68/140 |
| 2004/0123631 | A1 | 7/2004 | Chang | |
| 2004/0129035 | A1 | 7/2004 | Chang | |
| 2004/0163426 | A1 * | 8/2004 | Kim et al. | 68/23 A |
| 2004/0244121 | A1 | 12/2004 | Lim et al. | |
| 2004/0250442 | A1 | 12/2004 | Ryu | |
| 2005/0223503 | A1 | 10/2005 | Hong et al. | |

FOREIGN PATENT DOCUMENTS

| | | | |
|---|---|---|---|
| EP | 0252323 | | 1/1988 |
| EP | 252323 | A2 * | 1/1988 |
| EP | 1433890 | | 6/2004 |
| EP | 1433891 | | 6/2004 |
| EP | 1486605 | | 12/2004 |
| GB | 2230330 | | 10/1990 |
| JP | 2003245489 | | 9/2003 |
| JP | 2004209255 | | 7/2004 |

(Continued)

OTHER PUBLICATIONS

U.S. Appl. No. 11/032,110 to Hong , Which was filed on Jan. 11, 2005.

(Continued)

*Primary Examiner* — Joseph L Perrin
(74) *Attorney, Agent, or Firm* — Ked & Associates, LLP

(57) ABSTRACT

A drum type washing machine includes a cabinet, a tub fixed in the cabinet, and a drum that performs a washing process. A motor rotates the drum, a supporting device that extends from a rotation shaft of the motor to the cabinet rotatably support the drum. A buffering-and-sealing device is provided at the rear side of the tub to buffer a space between the rotation shaft and the tub and to seal the rear side of the tub. A drying device extends from one side of the tub to the other side of the tub to circulate air in the drum and to dry laundry in the drum. Thus, the size of the washing machine is reduced, the washing capacity thereof is increased, and laundry is dried by the drying device.

28 Claims, 4 Drawing Sheets

FOREIGN PATENT DOCUMENTS

| | | | |
|---|---|---|---|
| JP | 2004229718 | A * | 8/2004 |
| KR | 1998-010233 | | 5/1998 |
| KR | 2004-058999 | | 7/2004 |
| WO | WO 03/057967 | | 7/2003 |
| WO | WO 03/057968 | | 7/2003 |

OTHER PUBLICATIONS

U.S. Appl. No. 11/032,168 to Hong , Which was filed on Jan. 11, 2005.

English Language Abstract of KR 2004-058999.

Japanese Office Action dated Jul. 26, 2010.

U.S. Office Action issued in U.S. Appl. No. 13/111,723 dated Aug. 30, 2011.

U.S. Office Action issued in U.S. Appl. No. 13/111,707 dated Sep. 6, 2011.

* cited by examiner

DRUM TYPE WASHING MACHINE

The present disclosure relates to subject matter contained in priority Korean Application No. 2005-10138, filed on Feb. 3, 2005, the disclosure of which is herein expressly incorporated by reference in its entirety.

BACKGROUND OF THE INVENTION

1. Field of the Invention

The present invention relates to a drum type washing machine, and more particularly, to a drum type washing machine having a drying device, in which a tub is directly connected to a cabinet.

2. Description of the Related Art

Washing machines may be broadly categorized into those having only a washing function and washing machines having washing and drying functions.

FIG. 1 is a side sectional view illustrating the inner structure of a conventional drum type washing machine having a drying device.

As shown in the drawing, the conventional drum type washing machine includes a tub 10 supported in a cabinet 2 by a spring 4 and a damper 6, a drum 20 installed in the tub 10 to accommodate laundry, a door 22 connected to the cabinet 2 to open and close the front side of the drum 20, a heater duct 30 installed at the upper side of the tub 10 to discharge hot air to the tub 10 and having a heater 26 and a blower 27, and a condensing duct 40 having one side connected to a lower side of the tub 10 and the other side connected to the heater duct 30 and condensing the humidity or moisture out of the circulated air.

A gasket 12, closely contacting the door 22 when the door 22 is closed and connected to the heater duct 30, is installed to the tub 10.

The tub 10 includes a motor 14 for rotating the drum 20.

A water supplying device 15, for supplying washing water or rinsing water into the tub 10 in washing mode or rinsing mode, is connected to the tub 10. The lower side of the tub 10 is connected to the drain device 16.

The drain device 16 includes a drain bellows 17 connected to the lower side of the tub 10, a drain pump 18 connected to the drain bellows 17, and a drain hose 19 connected to the drain pump 18.

The drum 20 has penetrating holes 22 formed in the circumference or in the rear side thereof, through which washing water and air pass.

The drum 20 includes a lifter 24 installed on the inner circumference of the drum 20 to agitate the laundry.

The blower 27 includes a circulation fan 28 rotatably installed in the heater duct 30 and a fan motor 29 installed in the heater duct 30 to rotate the circulation fan 28.

The condensing duct 40 is connected to a cooling water supply 42 for supplying cooling water to condense humidity contained in air being circulated while drying the laundry.

The cooling water supply 42 includes a cooling water valve 44 connected to an external hose and intermittently controlling the cooling water supplied through the external hose and a cooling water hose 45 for guiding the cooling water passed through the cooling water valve 44 into the condensing duct 40.

Operation of the conventional drum type washing machine having the structure as described above will be described as follows.

First, with the door 22 closed and the conventional drum type washing machine started after placing laundry in the drum 20, the conventional drum type washing machine supplies washing water through the water supply 15. The supplied washing water flows into the tub 10 and is introduced into the drum 20 through the penetrating holes 22 to wet the laundry.

After supplying the washing water, when the motor 14 is driven, the drum 20 is rotated and the laundry in the drum 20 is stirred within the drum 20, thus dirt on the laundry is separated from the laundry by the washing water. As such, after the washing cycle is completed, contaminated washing water in the tub 10 is drained out of the conventional drum type washing machine through the drain device 16.

Afterwards, the rinsing cycle for removing foam or suds remaining in the laundry is performed several times. During the rinsing cycle, the water supply 15 and the motor are controlled like the washing cycle to rinse the foam remaining in the laundry and the contaminated washing water containing foam is drained out of the conventional drum type washing machine through the drain device 16.

After several rinsing cycles, a dehydration cycle, for dehydrating the laundry using centrifugal force, is performed. The motor 14 is driven at a high speed to dehydrate the laundry and the washing water dehydrated from the laundry is drained out of the conventional drum type washing machine through the drain device 16.

Next, the conventional drum type washing machine performs a drying cycle for drying the washed laundry.

In the drying cycle, when the conventional drum type washing machine drives the motor 14 to rotate the drum 20, the laundry is agitated in the drum 20. The heater 26 is turned on to increase the temperature within the drum, the fan motor 29 is driven to rotate the circulation fan 28, and the cooling water valve 44 and the drain pump 18 are repeatedly turned on and off in a predetermined time interval.

Due to the rotation of the circulation fan 18, air in the drum 20 strikes the laundry to remove heat and moisture from the laundry and is transformed into low-temperature-and-high-humidity air. The transformed air passes through the penetrating holes 22 and flows between the drum 20 and the tub 10, and then enters the condensing duct 40. The low-temperature-and-high-humidity air is condensed by the cooling water while passing through the condensing duct 40.

The air passed through the condensing duct 40 is transformed into hot air by the heater 26 while passing through the heater 30. The hot air passes through the gasket 12 and is discharged into the inside of the gasket 16, and then is circulated in the drum 20. After that, the circulation is repeated to dry the laundry.

Meanwhile, the cooling water supplied to the condensing duct 40 passes through the condensing duct 40, is collected in the tub 10, and is periodically pumped by the drain pump 18 to be discharged from the conventional drum type washing machine.

As such, after performing the drying process using the hot air, the heater 26 is turned off, and only the drum 20 and the circulation fan 28 rotate to perform a dry process using cold air.

When the dry process using cold air is performed for a predetermined time, the conventional drum type washing machine stops the circulation fan 28 and the motor 14 to finish the drying process.

However, as described above, according to the conventional drum type washing machine having a drying device, since an inlet duct 31, connected to the heater duct 30, is connected to the gasket 12, a space between the cabinet 2 and the tub 10 is needed, so that the size of the conventional drum type washing machine is increased.

Moreover, since a part of air discharged through the inlet duct 31 is directly introduced into the tub 10 through an opening formed between the tub 10 and the drum 20 without passing through the interior of the drum 20 and is discharged, the efficiency of laundry drying operation is deteriorated.

SUMMARY OF THE INVENTION

Therefore, the present invention has been made in view of the above and/or other problems, and it is an object of the present invention to provide a drum type washing machine in which a tub is integrally formed with a cabinet to reduce the size of the drum type washing machine and a drying device is installed to dry laundry directly after washing the laundry.

It is another object of the present invention to provide a drum type washing machine in which a duct, through which dry air is circulated, is directly connected to the inside of a tub without passing a gasket between the tub and a drum and a drum gasket is installed between the tub and the drum, maximizing an effective flow rate of air introduced into the drum to effectively dry laundry.

In accordance with the present invention, the above and other aspects can be accomplished by the provision of drum type washing machine including a cabinet, a tub directly fixed in the cabinet, a drum, disposed in the tub, in which washing is performed, a motor disposed at the rear side of the tub to rotate the drum, a supporting device extended from a rotation shaft between the drum and the motor to the cabinet to rotatably support the drum, a buffering-and-sealing device provided at the rear side of the tub to buffer a space between the rotation shaft and the tub and to seal the rear side of the tub, and a drying device extended from one side of the tub to the other side of the tub to circulate air in the drum and to dry laundry in the drum.

Preferably, the drying device includes a circulation duct extended from the outer side of the tub to the front side of the tub, a condensing device installed near the inlet of the circulation duct to condense humidity, a blower installed in the circulation duct to compulsorily circulate air, and a heater installed in the circulation duct to heat the circulated air.

The condensing device includes a metal condensing plate installed to the inner surface of the tub to condense the humidity, and a cold water supply for supplying cold water to condense the humidity toward the condensing plate through an inlet port of the circulation duct or the tub.

The circulation duct includes an inlet duct extended from the rear upper outer side of the tub to the blower, a heater duct, in which the heater is installed, extended from an outlet duct of the blower to the front side of the tub, and a connection duct extended from the heater duct to the front side of the tub.

Preferably, the tub further includes a duct bracket for supporting the heater.

The drum type washing machine further includes gaskets respectively installed between the tub and the drum to prevent foreign matter from entering a space between the tub and the drum and to prevent the drum from colliding against the tub.

Preferably, the gaskets include a drum gasket fixed to the drum and extended toward the tub, and a tub gasket fixed to the cabinet or the tub and extended toward the drum.

An outlet port of the circulation duct is positioned between the drum gasket and the tub gasket.

The another object of the present invention is achieved by the provision of a drum type washing machine including a cabinet, a tub installed in the cabinet, a drum, disposed in the tub, in which washing is performed, a motor disposed at the rear side of the tub to rotate the drum, a drying device extended from one side of the tub to the front side of the tub to circulate air in the drum and to dry laundry in the drum, and a dry air guide member installed between the tub and the drum to guide air circulated by the drying device into the drum.

Preferably, the dry air guide member includes a gasket installed between the tub and the drum to seal an opening formed between the tub and the drum.

The gasket includes a drum gasket fixed to the drum and extended toward the tub.

Still another object of the present invention is achieved by the provision of a drum type washing machine including a cabinet, a tub directly fixed in the cabinet, a drum disposed in the tub, in which washing is performed, a motor disposed at the rear side of the tub to rotate the drum, a supporting device extended from a rotation shaft between the drum and the motor to the cabinet to rotatably support the drum, a buffering-and-sealing device provided at the rear side of the tub to buffer a space between the rotation shaft and the tub and to seal the rear side of the tub, gaskets installed between the tub and the drum to seal an opening formed between the tub and the drum, and a drying device extended from the rear side of the tub to the front side of the tub to circulate air in the drum and to dry laundry in the drum.

Preferably, the drying device includes a circulation duct extended from the outer side of the tub to a space between the gaskets, a condensing device installed near the inlet of the circulation duct to condense humidity, a blower installed in the circulation duct to compulsorily circulate air, and a heater installed in the circulation duct to heat the circulated air.

The circulation duct includes an inlet duct extended from the outer side of the tub to the blower, a heater duct, in which the heater is installed, extended from an outlet duct of the blower to the front side of the tub, and a connection duct extended from the heater duct to a space between the gaskets.

Preferably, the tub further includes a duct bracket for supporting the heater duct.

The condensing device includes a metal condensing plate installed to the side of the tub to condense the humidity, and a cold water supply for supplying cold water to condense the humidity toward the condensing plate through an inlet port of the circulation duct or the tub.

The gaskets include a drum gasket fixed to the drum and extended toward the tub, and a tub gasket fixed to the cabinet or the tub and extended toward the drum.

Preferably, outlet port, through which the circulated air is discharged from the drying device, is positioned between the drum gasket and the tub gasket.

Preferably, the gaskets are positioned between the tub and the drum and guide air circulated by the drying device into the drum.

As described above, according to the drum type washing machine according to the present invention, since the tub is integrally installed to the cabinet, the drum type washing machine can be reduced in size or the washing capacity of the drum type washing machine can be increased without increasing the size of the drum type washing machine.

Moreover, the drum type washing machine of the present invention includes the drying device so that laundry is dried directly after the washing process.

In addition, according to the drum type washing machine of the present invention, since a duct, through which dry air is circulated, is connected directly to the inside of the tub without passing through the gasket between the tub and the drum and the drum gasket is installed between the openings of the tub and the drum, the effective flow rate of air introduced into the drum is maximized so that the laundry can be more effectively dried.

BRIEF DESCRIPTION OF THE DRAWINGS

The above and other objects, features and advantages of the present invention will be made apparent from the following description of the preferred embodiments, given as non-limiting examples, with reference to the accompanying drawings, in which.

DESCRIPTION OF THE PREFERRED EMBODIMENTS

Figure 1:
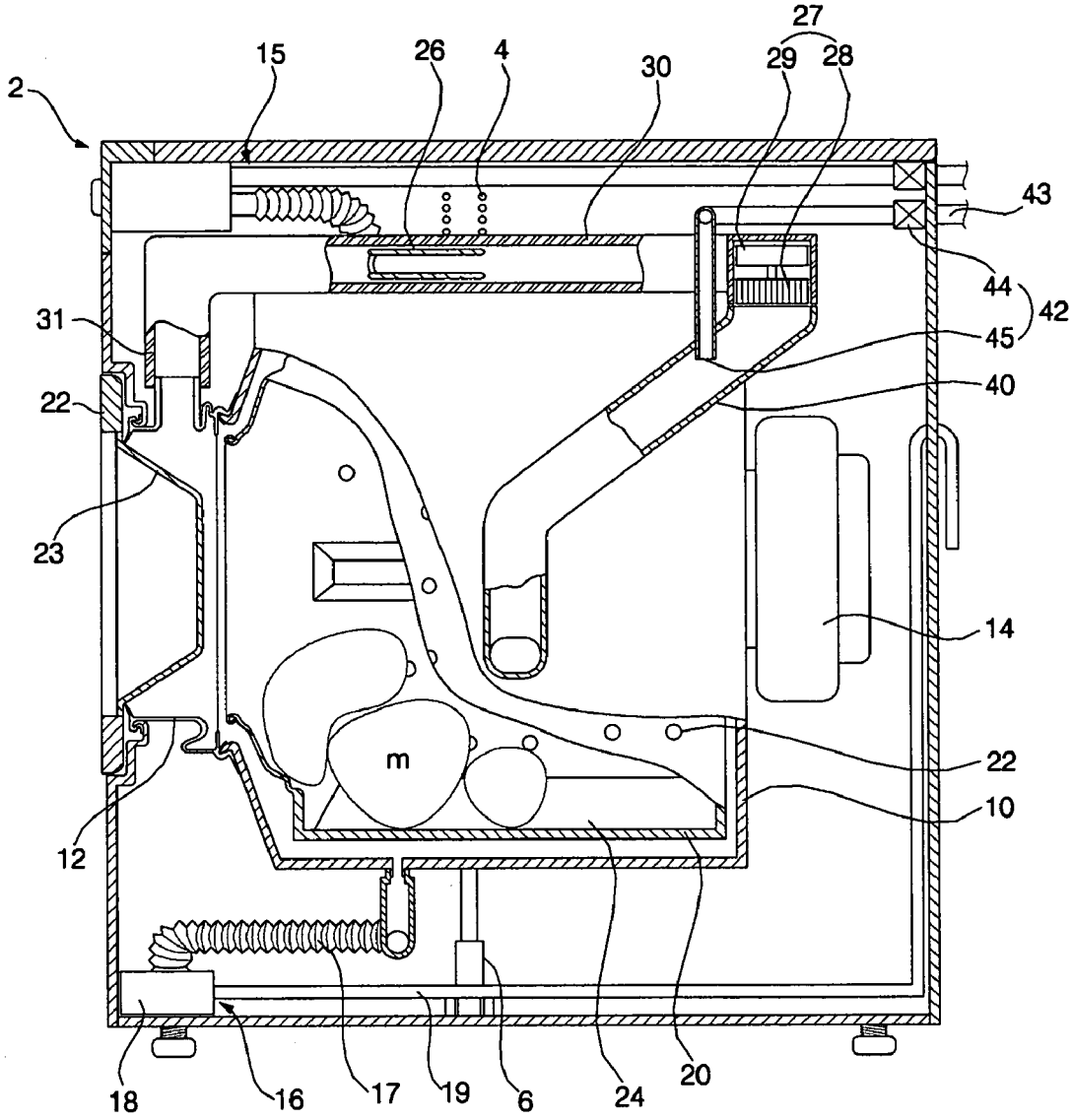
FIG. 1 (Prior Art)
FIG. 1 is a view illustrating an inner structure of a conventional drum type washing machine having a drying device.

The present invention is further described in the detailed description which follows, by reference to the noted plurality of drawings by way of non-limiting examples of preferred embodiments of the present invention, in which like reference numerals represent similar parts throughout the several views of the drawings.

Hereinafter, the preferred embodiments of the drum type washing machine according to the present invention will be described in detail with reference to the accompanying drawings.

Although several embodiments of the drum type washing machines according to the present invention are possible, hereinafter, only the drum type washing machine according to the preferred embodiment of the present invention will be described.

Figure 2:
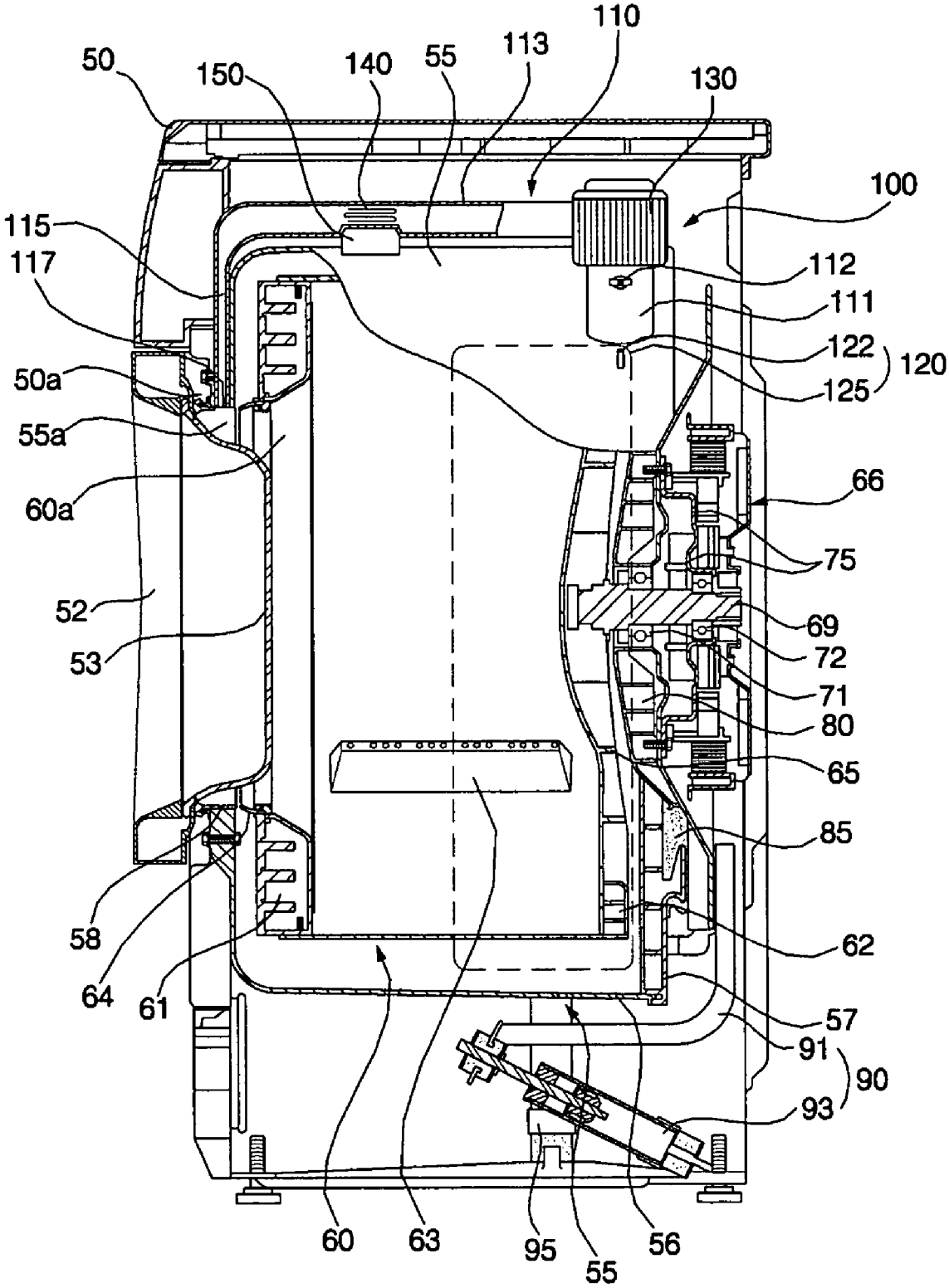
FIG. 2 is a view illustrating an inner structure of a drum type washing machine according to a preferred embodiment of the present invention.
Figure 3:
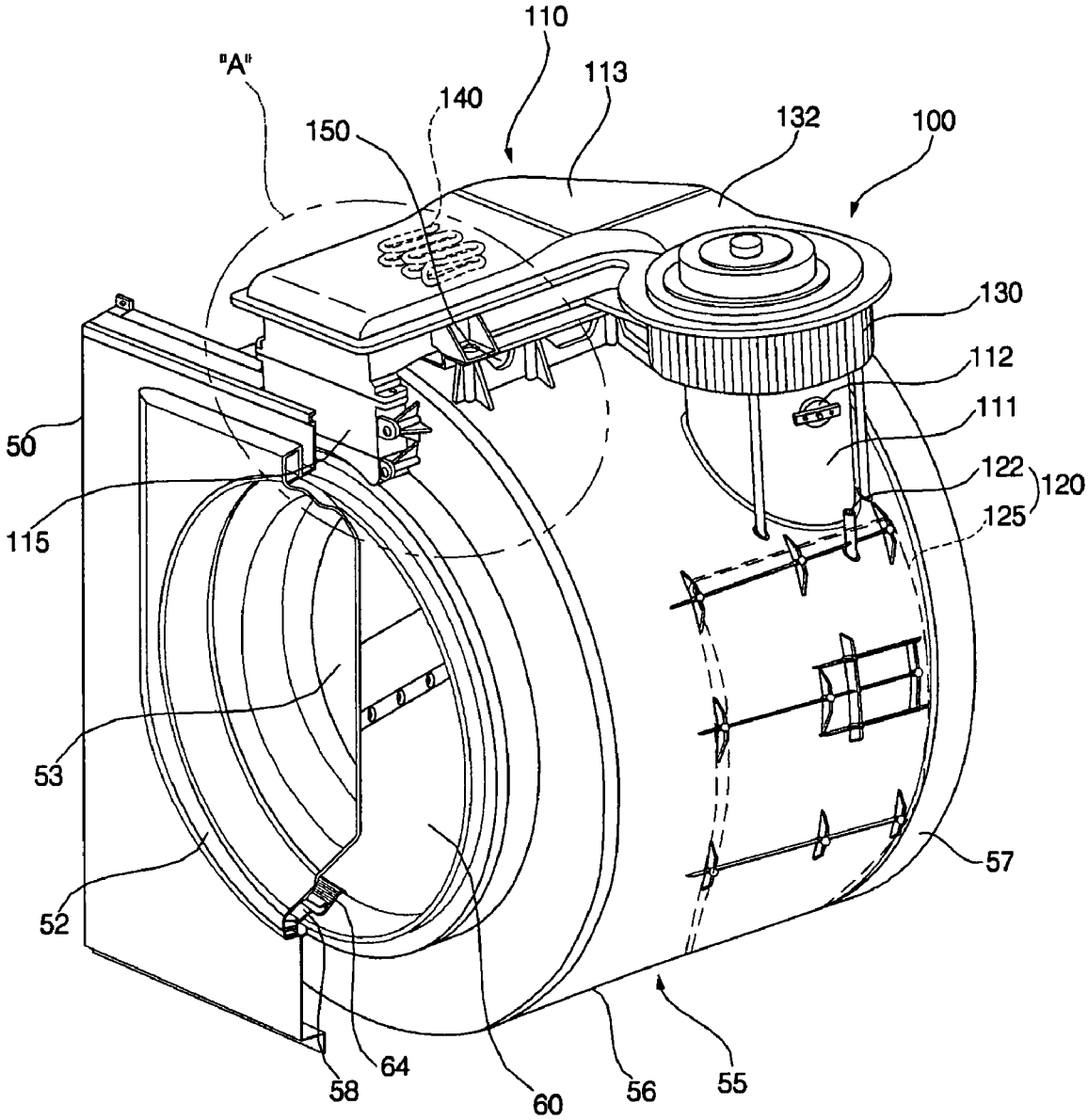
FIG. 3 is a perspective view illustrating main parts of the drum type washing machine according to the preferred embodiment of the present invention.
Figure 4:
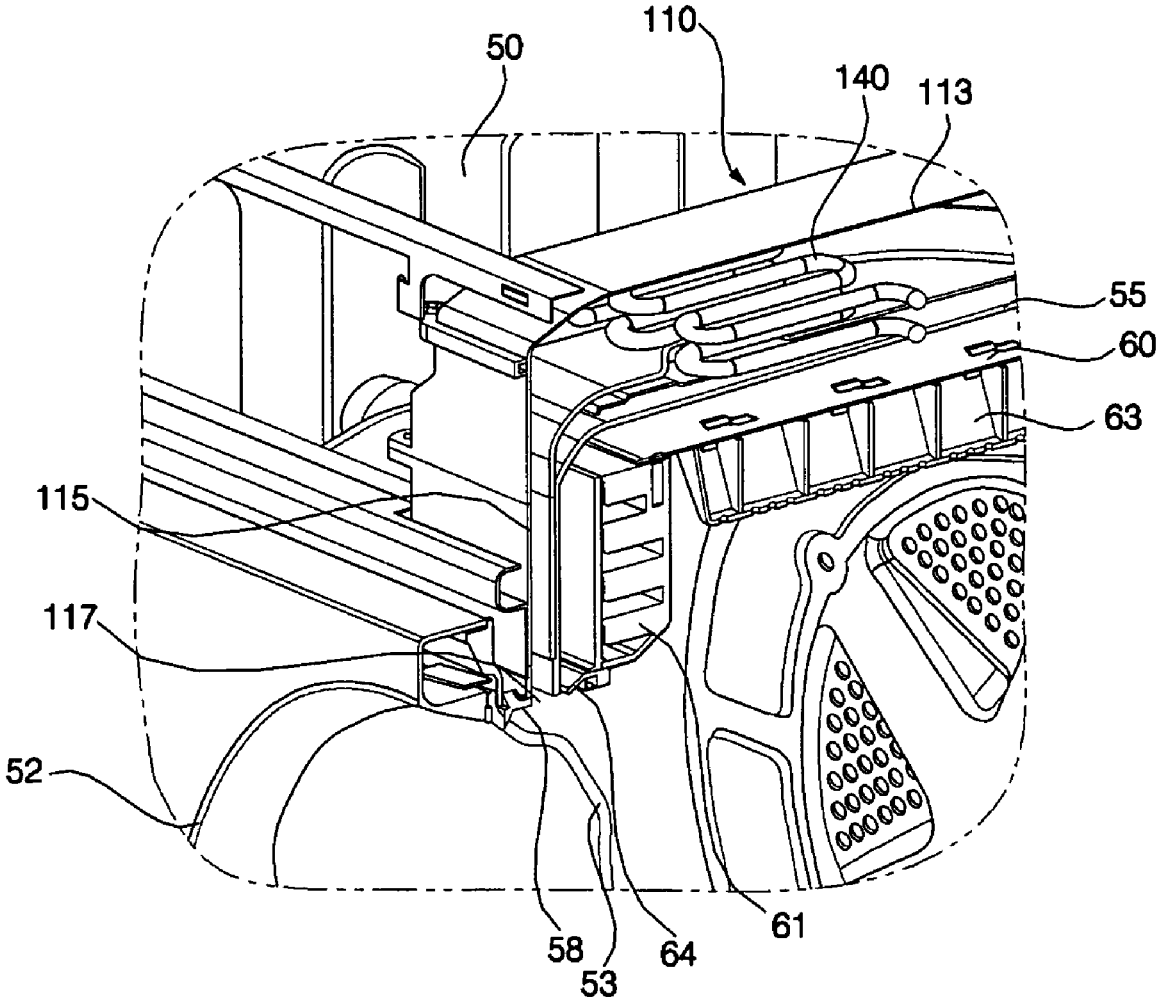
FIG. 4 is a partially sectional perspective view of a portion "A" in FIG. 3.

FIG. 2 is a view illustrating an inner structure of the drum type washing machine according to the preferred embodiment of the present invention. FIG. 3 is a perspective view illustrating main parts of the drum type washing machine according to the preferred embodiment of the present invention, and FIG. 4 is a partially sectional perspective view of a portion "A" in FIG. 3.

As shown in the drawings, the drum type washing machine according to the preferred embodiment of the present invention includes a rectangular box-shaped cabinet 50 to which a tub 55 for accommodating washing water is directly connected. In other words, although, in the conventional drum type washing machine, a tub is connected to a cabinet by a spring and a damper, in the drum type washing machine according to the preferred embodiment of the present invention, the tub 55 is directly fixed to the cabinet 50 without a damper.

As such, a drum 60, in which the tub 55 is directly installed and the laundry is washed, and vibration generating elements, such as a motor 66 for rotating the drum 60, are supported in the cabinet 50 by a supporting device, including a bearing housing 75 and a suspension 90 which are described later, such that vibration generated when the drum 60 is rotated can be reduced.

In other words, the drum 60 is connected to the motor 66 via a rotation shaft 69 and is rotated by the motor 66. Between the drum 60 and the motor 66, a bearing housing 75, including bearings 71 and 72, which comprise supporting devices for supporting the rotation shaft 69, is installed. The suspension 90 is connected to the bearing housing 75 such that elements subject to vibration, such as the drum 60, the motor 66, and the like, are supported in the cabinet 50 by the bearing housing 75.

In front of the bearing housing 75, a buffering-and-sealing device is provided at the rear side of the tub 55 to buffer a space between the rotation shaft 69 and the tub 55 and to seal the rear side of the tub 55. The buffering-and-sealing device includes a bracket 80 for forming the rear side of the tub 55, and a rear gasket 85 installed between the bracket 80 and the rear portion of the tub 55 to prevent vibration from being transmitted from the vibration generating elements to the tub 55 and to prevent water accommodated in the tub 55 from leaking.

The cabinet 50, the tub 55, and the drum 60 have respective openings 50*a*, 55*a*, and 60*a*, formed therein, through which the laundry is placed and withdrawn. Gaskets 58 and 64 are respectively installed between the tub 55 and the drum 60 to prevent foreign matter from entering the space between the tub 55 and the drum 60 and to prevent the drum 60 from colliding with the tub 55 during the washing process and the dehydrating process (i.e., spinning and/or drying).

Especially, the drum type washing machine according to the preferred embodiment of the present invention further includes a drying device 100 for drying the washed laundry.

The drying device 100 extends from the rear upper side of the tub 55 to the front side of the tub 55, i.e., towards the gaskets 58 and 64, to dry the laundry in the drum 60 by circulating air in the drum 60.

Main parts of the drum type washing machine having the structure as described above will be described in detail as follows.

The cabinet 50 is preferably formed in a rectangular box-shape like that of the conventional drum type washing machine, and includes a door 52 installed at the front side thereof to open and close the tub 55.

The tub 55 includes a tub main body 56 directly fixed to the front side of the cabinet 50, and a ring-shaped tub cover 57, which is installed at the rear side of the tub main body 56 and includes an intermediate part where the bracket 80 and the rear gasket 85 are positioned.

The drum 60 is supported such that the rear part of the drum 60 is connected to the rotation shaft 69, and has a hub 65 to which the rotation shaft 69 is connected. The drum 60 includes a plurality of lifters 63 installed at the inner side thereof to raise and release the laundry in the drum 60. The drum 60 further includes balancers 61 and 62 installed at the front and rear sides of the drum 60 to balance the drum 60 during the rotation of the drum 60.

The suspension 90 includes a damper bracket 91 connected to the bearing housing 75 and dampers 93 and 95 installed between the damper bracket 91 and a base of the cabinet 50, in which the main damper 93, located between the dampers 93, is installed at an angle and the sub-dampers 95, located at both lateral sides of the main damper 93, are installed an a right angle so as to absorb vibration generated from the vibration elements.

The gaskets include a tub gasket 58 fixed to the cabinet 50 or the tub 55 and extending toward the drum 60, and a drum gasket 64 fixed to the drum 60 and extending toward the tub 55.

Here, the drum gasket 64 serves as a dry air guide member to guide air circulated by the drying device 100 into the drum 60.

The drying device 100 includes a circulation duct 110 extended from the outer side of the tub 55 to the front side of the tub 55, a condensing device 120 installed near to the inlet of the circulation duct 110 to condense humidity, a blower 130 installed in the circulation duct 110 to forcibly circulate air, and a heater 140 installed in the circulation duct 110 to heat the circulated air.

The circulation duct 110 includes an inlet duct 111 extended from the rear upper outer side of the tub 55 to the blower 130, a heater duct 113, in which the heater 140 is installed, extended from an outlet duct 132 of the blower 130 to the front side of the tub 55, and a connection duct 115 extended from the heater duct 113 to the front side of the tub 55.

Here, the inlet duct 111 includes a temperature sensor 112 for detecting the temperature of the circulated air, the tub 55 includes a duct bracket 150, installed at the upper side of the tub 55, for supporting the heater duct 113 to be spaced apart from the tub 55 so as to prevent heat generated by the heater 140 from being radiated to the tub 55.

One end of the connection duct 115 serving as an outlet port 117 of the circulation duct 110, as shown in FIG. 4, is positioned between the drum gasket 64 and the tub gasket 58.

The condensing device 120 includes a metal condensing plate 125 installed to the inner surface of the tub 55 to condense humidity, and a cold water supply 122 for supplying cold water to condense humidity to the condensing plate 125 through an inlet port of the circulation duct 110 or the tub 55.

Operation of the drum type washing machine having the structure as described above according to the preferred embodiment of the present invention will be described as follows.

According to the drum type washing machine in accordance with the preferred embodiment of the present invention, since the tub 55 is directly installed to the cabinet 50, the size of the tub 55 can be maximized without increasing the volume of the cabinet even when the cabinet 50 has the same volume as that of the cabinet of the conventional drum type washing machine. Thus, since the drum 60 installed in the tub 55 can also be relatively increased in size, the washing capacity of the drum type washing machine according to the preferred embodiment of the present invention can be increased without increase of the size of the cabinet 50.

In the drum type washing machine according to the preferred embodiment of the present invention, when the drying process is performed after the dehydration process, the drum 60 rotates at low speed. Simultaneously, the blower 130 and the heater 140 are driven to supply and circulate the hot air, thereby drying the laundry.

In other words, the hot air heated by the heater while passing through the heater duct 113 is discharged into the tub 55 via the connection duct 115, the discharged hot air is reflected by a door glass 53 and is introduced to the drum 60 to dry the laundry.

Meanwhile, since, between the drum 60 and the tub 55, the drum gasket 64 is installed to the drum 60 and extends toward the tub 55 to serve as a guide member for guiding the dry air, the majority of the hot air discharged from the connection duct 115 is introduced into the drum 60 to dry the laundry and flows out toward the tub 55. Thus, since the quantity of air, which is discharged from the connection duct 115 and is directly introduced into the tub 55, is minimized due to the drum gasket 64, the drying effect of the laundry is enhanced.

As such, the humid air, generated by drying the laundry in the drum 60, passes through the holes formed in the front and rear sides of the drum and contact the condensing plate 125 installed at the side of the tub 55 such that the high-temperature-and-humid air is condensed and discharged from the drum type washing machine through the drain device provided in the bottom of the tub 55. At that time, since the condensing plate 125 is continuously or intermittently supplied with water by the cold water supply 125, the condensing plate 125 is maintained at a low temperature and condenses the humid air.

As such, the air loses a predetermined quantity of humidity as it passes through the blower 130 and is introduced into the heater duct 113. The heater 140 heats the air again, and the heated air is supplied to the drum 60 to further dry the laundry.

As described above, according to the drum type washing machine according to the present invention, since the tub is integrally installed to the cabinet, the drum type washing machine can be reduced in size or the washing capacity of the drum type washing machine can be increased without increasing the size of the drum type washing machine.

Moreover, the drum type washing machine of the present invention includes the drying device so that laundry is dried directly after the washing process.

In addition, according to the drum type washing machine of the present invention, since a duct, through which dry air is circulated, is connected directly to the inside of the tub without passing through the gasket between the tub and the drum and the drum gasket is installed between the openings of the tub and the drum, the effective flow rate of air introduced into the drum is maximized so that the laundry can be more effectively dried.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

What is claimed is:

1. A drum-type washing machine comprising:

a tub having an inlet to allow in hot air and an outlet to discharge the hot air out of the tub, the tub providing a condensing space in which the hot air is condensed;

a drum rotatably placed in the tub;

a condensing device placed in the tub;

a duct to circulate the condensed hot air, the duct directly connected to the inlet and outlet of the tub to receive the condensed air through the outlet and resupply into the tub through the inlet such that the hot air is condensed more in the condensing space of the tub than in the duct;

a heater to heat the air of the duct;

a blower to blow the air of the duct toward the tub, wherein the duct is disposed at an upper portion of the tub and the inlet is positioned at a front portion of the tub and the outlet is positioned at a rear portion of the tub, and wherein the outlet of the tub is positioned over the condensing device such that the condensed hot air from the condensing device flows into the duct.

2. The drum-type washing machine of claim 1, wherein the inlet is located in front of a laundry entrance opening of the drum.

3. The drum-type washing machine of claim 2, wherein the inlet is located at an upper portion which is extended forward from a front wall of the tub.

4. The drum-type washing machine of claim 3, wherein the duct is coupled to the inlet toward an upper portion of a door glass such that the hot air from the duct flows toward the upper portion of a door glass.

5. The drum-type washing machine of claim 4, wherein a portion of the duct coupled to the inlet is arranged vertically for the hot air to flow into the tub vertically.

6. The drum-type washing machine of claim 3, wherein the inlet is placed right over an upper portion of a door glass.

7. The drum-type washing machine of claim 1, wherein the outlet is formed in a circumferential surface of the tub.

8. The drum-type washing machine of claim 7, wherein the outlet is located at an upper and rear portion of the tub.

9. The drum-type washing machine of claim 8, wherein the outlet is formed to extend vertically upward from the circumferential surface.

10. The drum-type washing machine of claim 1, wherein the inlet is formed in an upper and front portion of the tub in front of a laundry entrance opening of the drum, and the outlet is formed in an upper and rear portion of a circumferential surface of the tub.

11. The drum-type washing machine of claim 10, wherein portions of the duct coupled to the inlet and outlet are vertically coupled thereto such that the hot air flows vertically into and out of the tub.

12. The drum-type washing machine of claim 1, further comprising a water supply portion to supply water to cool the condensing space of the tub to condense the hot air.

13. The drum-type washing machine of claim 12, wherein the water supply portion is formed at a circumferential surface of the tub.

14. The drum-type washing machine of claim 1, further comprising a metal condensing plate inside the tub.

15. The drum-type washing machine of claim 14, wherein the condensing plate is mounted on an inner circumferential surface of the tub below the outlet.

16. The drum-type washing machine of claim 14, further comprising a water supply portion to supply water to the condensing plate.

17. The drum-type washing machine of claim 1, further comprising a suspension attached to a bearing housing which is to rotatably support a rotational shaft connected to the drum.

18. The drum-type washing machine of claim 1, further comprising:

a driving assembly comprising a rotational shaft connected to the drum, a bearing housing to rotatably support the rotational shaft, and a motor to rotate the rotational shaft; and a rear gasket to prevent water inside the tub from leaking toward the driving assembly and allow the driving assembly to move relatively to the tub.

19. The drum-type washing machine of claim 1, wherein the tub is fixedly supported.

20. The drum-type washing machine of claim 1, further comprising:

a condenser to condense the hot air, the condenser located within the tub and included in said space.

21. The drum-type washing machine of claim 19, wherein the blower is located such that a length of a flow line of the hot air from the tub to the blower is shorter than a length of a flow line of the hot air returning to the tub from the blower.

22. A drum type washing machine comprising:

a tub having an inlet to allow in hot air and an outlet to discharge the hot air out of the tub, the tub providing a space in which the hot air is condensed;

a drum rotatably placed in the tub;

a condensing device placed inside the tub;

a duct to circulate the condensed hot air, the duct directly connected to the inlet and outlet of the tub to receive the condensed air through the outlet and resupply into the tub through the inlet such that the hot air is condensed substantially mainly in the space of the tub;

a heater to heat the air of the duct;

a blower to blow the air of the duct toward the tub, wherein the duct is disposed at an upper portion the tub and the inlet is positioned at a front portion of the tub and the outlet is positioned at a rear portion of the tub a prescribed distance above a center horizontal line that bisects the drum, and wherein the outlet of the tub is positioned over the condensing device such that the condensed hot air from the condensing device flows into the duct.

23. A drum-type washing machine, comprising:

a tub;

a drum rotatably positioned inside the tub;

a pipe to supply cold water to a condensing device, the pipe positioned through a surface of the tub;

a circulation duct assembly for circulating condensed air, including a first duct provided over the tub to extend from a front region of the tub to a rear region of the tub;

a second duct coupled to the first duct and a circumferential surface of the tub and positioned at a prescribed angle relative to the first duct to extend downward to the tub;

a heater provided in the first duct; and a fan provided between the first and second ducts and configured to circulate condensed air from the tub toward the heater, wherein a portion of the second duct connected to the outer circumferential surface of the tub which corresponds to a shortest length of the second duct is positioned a prescribed distance above a center horizontal line that bisects the drum, and wherein the shortest length of the second duct is less than a length of the first duct.

24. The drum-type washing machine of claim 23, wherein the first duct includes a first portion that is positioned along a rotational axis of the drum and a second portion that is positioned at a second prescribed angle relative to the first portion, the first portion connected to an inlet of the drum and the second portion connected to the fan.

25. The drum-type washing machine of claim 24, wherein the first portion of the first duct is centered on a center vertical line that bisects the drum.

26. The drum-type washing machine of claim 24, wherein the second portion of the first duct is provided at a height equal to a height of the first duct.

27. The drum-type washing machine of claim 24, wherein the second duct is positioned substantially perpendicular to the first duct and substantially parallel to a center vertical line that bisects the drum.

28. The drum-type washing machine of claim 24, wherein the shortest length of second duct is less than a length of the first portion of the first duct.

* * * * *